US006382817B1

(12) United States Patent
Chelf

(10) Patent No.: US 6,382,817 B1
(45) Date of Patent: May 7, 2002

(54) CONVERTIBLE LIGHTING FIXTURE WITH ADJUSTABLE REFLECTORS AND A METHOD OF INSTALLING A REFLECTOR TO A LIGHTING FIXTURE

(75) Inventor: Bentley Chelf, Laguna Nigel, CA (US)

(73) Assignee: General Innovation, LLC, Mansfield, TX (US)

( * ) Notice: Subject to any disclaimer, the term of this patent is extended or adjusted under 35 U.S.C. 154(b) by 0 days.

(21) Appl. No.: 09/425,078

(22) Filed: Oct. 21, 1999

(51) Int. Cl.[7] ..... F21V 17/02

(52) U.S. Cl. ..... 362/322; 362/282; 362/283; 362/217; 362/223; 362/449

(58) Field of Search ..... 362/282, 283, 362/217, 223, 449, 322, 16, 17, 18

(56) References Cited

U.S. PATENT DOCUMENTS 5,117,342 A * 5/1992 Vlah ..... 362/217
5,459,649 A * 10/1995 Ellion ..... 362/187
5,855,427 A * 1/1999 Lassovsky ..... 362/283
5,988,836 A * 11/1999 Swarens ..... 362/364
6,332,695 B1 * 10/2001 Wang ..... 362/277

* cited by examiner

*Primary Examiner*—Sandra O'Shea
*Assistant Examiner*—Anabel Ton
(74) *Attorney, Agent, or Firm*—Haynes and Boone, LLP

(57) ABSTRACT

A lighting fixture according to which at least one reflector is pivotally mounted to a housing by at least one mounting member. A locking element is provided for locking the mounting member, and therefore the reflector, in one of a plurality of predetermined angular positions relative to the housing. A method of installing a reflector to a housing member of a lighting fixture according to which a mounting member is pivotally mounted to the housing member, the reflector is attached to the mounting member, and the mounting member, and therefore the reflector, are locked in one of a plurality of predetermined angular positions relative to the housing.

24 Claims, 2 Drawing Sheets

CONVERTIBLE LIGHTING FIXTURE WITH ADJUSTABLE REFLECTORS AND A METHOD OF INSTALLING A REFLECTOR TO A LIGHTING FIXTURE

BACKGROUND

The present invention relates to a convertible lighting fixture with adjustable reflectors and a method of installing a reflector to a lighting fixture.

Lighting fixtures for receiving elongated tubular fluorescent bulbs are commonplace and many are marketed in two basic forms—a "shop light" that has two reflectors for reflecting the light, and a "strip light" that is similar to the shop light but has no reflectors. This requires manufacturers, retailers, and customers to deal with two separate inventories which is inconvenient and costly.

Also, the reflectors of the shop lights are affixed to the fixture housing in a predetermined position and can't be adjusted to accommodate varying lighting applications.

Therefore, what is needed is a lighting fixture of the above type which can be converted from a shop light to a strip light, or visa versa, by respectively attaching or removing the reflectors to the fixture housing. Also needed is a lighting fixture and method in which the reflectors can be adjusted relative to the fixture housing to accommodate varying lighting applications.

SUMMARY OF THE INVENTION

The present invention, accordingly, provides a lighting fixture according to which at least one reflector is pivotally mounted to a housing by at least one mounting member. A locking element is provided for locking the mounting member, and therefore the reflector, in one of a plurality of predetermined angular positions relative to the housing.

The present invention is also directed to a method of installing a reflector to a housing member of a lighting fixture according to which a mounting member is pivotally mounted to the housing member. A reflector is attached to the mounting member, and the mounting member, and therefore the reflector, is locked in one of a plurality of predetermined angular positions relative to the housing.

Several advantages are gained from the lighting fixture and the method of the present invention. For example, the reflector can be quickly attached and removed from the fixture housing to enable the fixture to be easily and quickly converted from a shop light to a strip light, and visa versa. Also, varying lighting applications can be accommodated.

DETAILED DESCRIPTION OF THE PREFERRED EMBODIMENT

Figures 1, 3A, 3B:
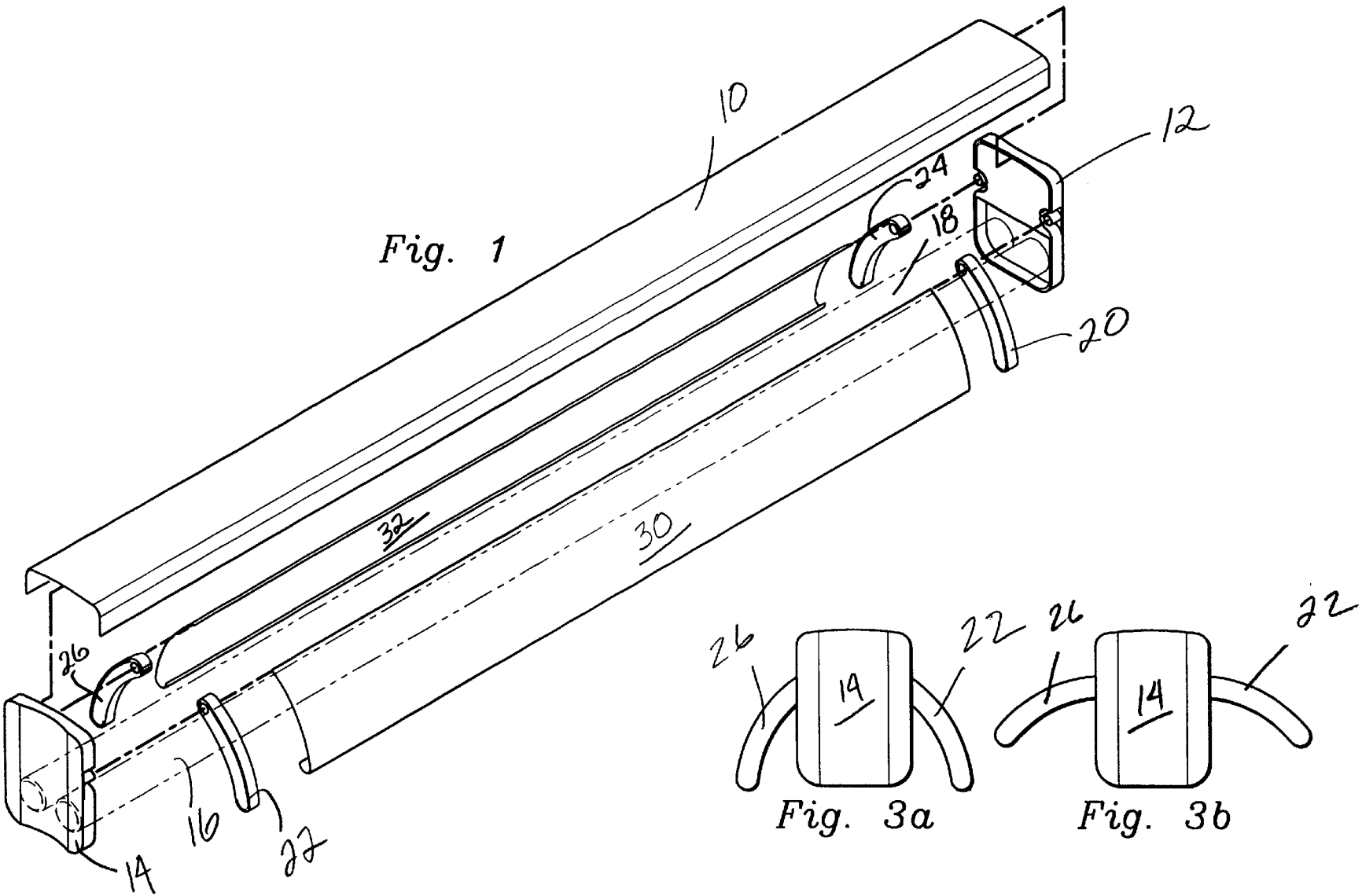
FIG. 1 is an exploded isometric view of a lighting fixture according to an embodiment of the present invention.
FIGS. 3*a* and 3*b* are end views of the lighting fixture of FIG. 1 depicting two positions of the reflectors relative to the fixture housing.

An embodiment of the lighting fixture of the present invention is shown in FIG. 1 and consists of a housing formed by a substantially U-shaped top plate 10 and two end plates 12 and 14 which extend over the respective ends of the plate 10 and are attached thereto in any conventional manner. Although not shown in the drawings, it is understood that two sockets are formed in the inner portion of each end plate 12 and 14.

Two elongated, tubular, fluorescent light bulbs 16 and 18 are mounted in the sockets of the end plates 12 and 14. To this end, electrically conductive nipples, or the like, (not shown) are provided on the respective ends of the bulbs 16 and 18 which are inserted in, and retained by, the above-mentioned sockets of the plate 12 and 14 to establish an electrical connection. Since the technique of mounting the bulbs 16 and 18 in the end plates 12 and 14 is conventional, it will not be described in any further detail.

A pair of mounting brackets 20 and 22 are mounted to one side wall of each of the end plates 12 and 14, respectively, and a pair of mounting brackets 24 and 26 are mounted to the other side wall of each of the end plates, in a manner to be described. The respective ends of a reflector 30 are mounted in corresponding slots formed in the brackets 20 and 22, respectively; and the respective ends of a reflector 32 are mounted in corresponding slots formed in the brackets 24 and 26, respectively. The reflector 30 is secured in the slots in the brackets 20 and 22, and the reflector 32 is secured in the slots in the brackets 24 and 26 by a friction fit, it being understood that fasteners, or the like, (not shown) can be utilized to further secure the reflectors in their corresponding brackets as needed.

It is understood that the top plate 10 and the reflectors 30 and 32 are fabricated from a relatively thin material, such as sheet metal, to enable them to bend, or flex, slightly under conditions to be described.

Figure 2A:
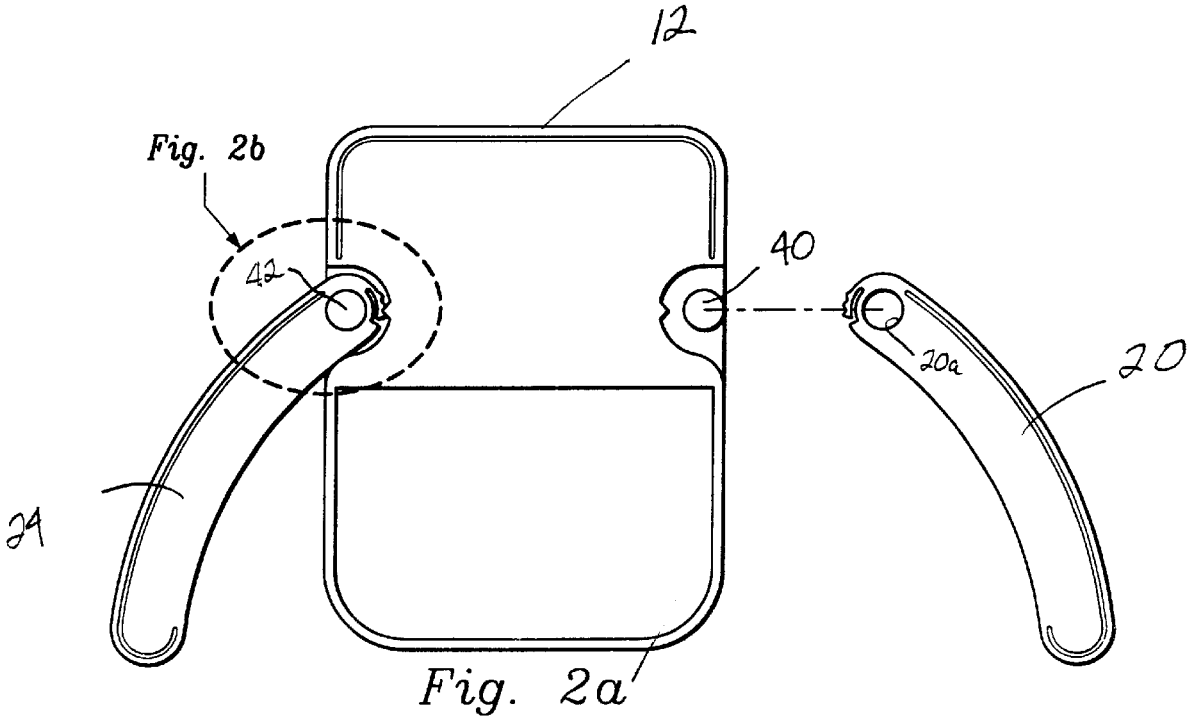
FIG. 2*a* is a partially exploded end view of the lighting fixture of FIG. 1.

As shown in FIG. 2*a*, a pair of posts 40 and 42 are provided in recessed portions along the respective sides of the inner portion of the end plate 12. The bracket 20 has a through opening 20*a* that receives the post 40, and the bracket 24 has a through opening that receives the post 42, to pivotally mount the brackets to the end plate 12.

Figure 2B:
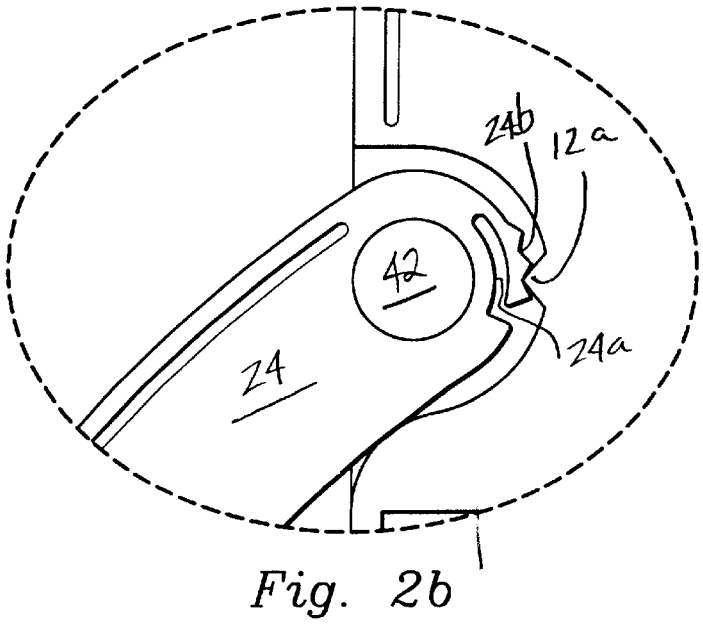
FIG. 2*b* is an enlarged view of the circled portion of the lighting fixture of FIG. 2*a* but showing the components of FIG. 2*a* in an assembled condition.

FIG. 2*b* better shows a slot 24*a* formed in an end portion of the bracket 24, and a plurality of grooves 24*b* formed in the outer surface portion of the latter end portion. That portion of the end plate 12 defining the corresponding recess is provided with a locking member, in the form of a projecting portion 12*a*, sized to extend in one of the grooves 24*b* to lock the bracket 24 to the end plate 12. It can be appreciated that the angular position of the bracket 24 relative to the end plate 12 can be varied by pivoting the bracket about the post 42 and allowing the portion 12*a* to extend in another one of the grooves 24*b*, which is facilitated by the flexibility imparted to the end portion of the bracket by the slot 24*a*. Since the bracket 20 is mounted to the post 40 on the other side of the end plate 12 in a similar manner as shown in FIG. 2*a*, and since the brackets 22 and 26 are mounted to the respective sides of the end plate 14 in an identical manner, they will not be described in any further detail.

It can be appreciated that the angular position of the reflectors 30 and 32 relative to the housing formed by the plates 10,12, and 14 can be varied by placing the projecting portion 12*a* of the end plate 12, and the other projecting portions associated with the end plates 12 and 14, in one of the grooves 24*b* of the bracket 24, and one of the corresponding grooves formed on the brackets 20, 22, and 26. Two typical angular positions of the brackets 22 and 26, and therefore the brackets 20 and 24 and the reflectors 30 and 32, respectively, are shown in FIGS. 3*a* and 3*b*.

The reflector 30 can easily be mounted to, and removed from, the housing formed by the top plate 10 and the end plates 12 and 14 by simply bending, or flexing, the reflector and the top plate 10 slightly to permit the brackets 20 and 22 to be mounted over, or removed from, their respective posts 40 and 42. The reflector 32 can be mounted to, and removed from, the latter housing in an identical manner.

The lighting fixture of the present invention thus enjoys several advantages. For example, it can easily and quickly be converted from a shop light to a strip light, and visa versa, and the adjustable reflectors enable varying lighting applications to be accommodated.

It is understood that variations may be made in the foregoing without departing from the scope of the present invention. For example, the aforementioned grooves can be provided on the end plates 12 and 14, and the projection member can be provided on the brackets 20, 22, 24 and 26. Also, the spatial references to "upper", "end", "side", etc. are done only for the convenience of presentation and are not intended to be limiting in any respect.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A lighting fixture comprising a housing; a locking member on the housing; at least one reflector; and at least one mounting member pivotally mounted to the housing, connected to the reflector, and having a plurality of grooves formed therein; the mounting member being manually pivotal relative to the housing to engage the locking member in one of the grooves for locking the mounting member, and therefore the reflector, in a corresponding angular position relative to the housing.

2. The fixture of claim 1 wherein the mounting member is manually pivotal to engage the locking member into another one of the grooves for locking the mounting member, and therefore the reflector, in another, corresponding angular position relative to the housing.

3. The fixture of claim 1 further comprising a post on the housing and an opening formed through the mounting member and extending over the post to pivotally mount the mounting member, and therefore the reflector, to the housing.

4. The fixture of claim 3 wherein the mounting member is quick-detachably mounted to the housing member by inserting the post in the opening.

5. The fixture of claim 3 wherein the mounting member can be removed from the housing by removing the mounting member from the post.

6. The fixture of claim 5 wherein the reflector is flexible to permit the mounting member to be removed from the post.

7. The fixture of claim 1 wherein there are two mounting members connected to the respective ends of the reflector and there are two locking members on the housing for respectively engaging the mounting members.

8. A lighting fixture comprising a housing having a plurality of grooves formed there; at least one reflector; and at least one mounting member pivotally mounted to the housing, connected to the reflector, and having a locking member formed thereon; the mounting member being manually pivotal relative to the housing to engage the locking member in one of the grooves for locking the mounting member, and therefore the reflector, in a corresponding angular position relative to the housing.

9. The fixture of claim 8 wherein the mounting member is manually pivotal to engage the locking member into another one of the grooves for locking the mounting member, and therefore the reflector, in another, corresponding angular position relative to the housing.

10. The fixture of claim 8 further comprising a post on the housing and an opening formed through the mounting member and extending over the post to pivotally mount the mounting member, and therefore the reflector, to the housing.

11. The fixture of claim 10 wherein the mounting member is quick-detachably mounted to the housing member by inserting the post in the opening.

12. The fixture of claim 10 wherein the mounting member can be removed from the housing by removing the mounting member from the post.

13. The fixture of claim 12 wherein the reflector is flexible to permit the mounting member to be removed from the post.

14. The fixture of claim 8 wherein there are two mounting members connected to the respective ends of the reflector and there are two sets of grooves on the housing for engagement by the locking members of the mounting members.

15. A method of installing a reflector to a housing of a lighting fixture, the method comprising the steps of forming a locking member on the housing, forming a plurality of grooves on a mounting member, pivotally mounting the mounting member to the housing, attaching the reflector to the mounting member, and manually pivoting the mounting member relative to the housing to engage the locking member in one of the grooves for locking the mounting member, and therefore the reflector, in a corresponding angular position relative to the housing.

16. The method of claim 15 further comprising manually pivoting the mounting member relative to the housing to engage the locking member into another one of the grooves for locking the mounting member, and therefore the reflector, in another, corresponding angular position relative to the housing.

17. The method of claim 15 further comprising providing a post on the housing and an opening through the mounting member, and inserting the post in the opening to pivotally mount the mounting member, and therefore the reflector, to the housing.

18. The method of claim 17 wherein the mounting member can be removed from the housing by removing the mounting member from the post.

19. The method of claim 15 further comprising forming another locking member on the housing, forming a plurality of grooves on an additional mounting member, pivotally mounting the additional mounting member to the housing, attaching the reflector to the additional mounting member and manually pivoting the additional mounting member relative to the housing to engage the other locking member in one of the grooves for locking the additional mounting member, and therefore the reflector, in a corresponding angular position relative to the housing.

20. A method of installing a reflector to a housing of a lighting fixture, the method comprising the steps of forming a plurality of grooves on the housing, forming a locking member on a mounting member, pivotally mounting the mounting member to the housing, attaching the reflector to the mounting member, and manually pivoting the mounting member relative to the housing to engage the locking member in one of the grooves for locking the mounting member, and therefore the reflector, in a corresponding angular position relative to the housing.

21. The method of claim 20 further comprising manually pivoting the mounting member relative to the housing to engage the locking member into another one of the grooves for locking the mounting member, and therefore the reflector, in another, corresponding angular position relative to the housing.

22. The method of claim 20 further comprising providing a post on the housing and an opening through the mounting member, and inserting the post in the opening to pivotally mount the mounting member, and therefore the reflector, to the housing.

23. The method of claim 22 wherein the mounting member can be removed from the housing by removing the mounting member from the post.

24. The method of claim 20 further comprising forming another set of grooves on the housing, forming an locking member on an additional mounting member, pivotally mounting the additional mounting member to the housing, attaching the reflector to the additional mounting member and manually pivoting the additional mounting member relative to the housing to engage the other locking member in one of the grooves for locking the additional mounting member, and therefore the reflector, in a corresponding angular position relative to the housing.

* * * * *